US012060662B2

(12) United States Patent
Izawa

(10) Patent No.: US 12,060,662 B2
(45) Date of Patent: Aug. 13, 2024

(54) TOWEL CLOTH AND MANUFACTURING METHOD THEREOF

(71) Applicant: IZAWA TOWEL CO., LTD., Tokyo (JP)

(72) Inventor: Shoji Izawa, Tokyo (JP)

(73) Assignee: IZAWA TOWEL CO. LTD., Tokyo (JP)

( * ) Notice: Subject to any disclaimer, the term of this patent is extended or adjusted under 35 U.S.C. 154(b) by 0 days.

(21) Appl. No.: 17/927,551

(22) PCT Filed: Apr. 5, 2022

(86) PCT No.: PCT/JP2022/017080

§ 371 (c)(1),
(2) Date: Nov. 23, 2022

(87) PCT Pub. No.: WO2022/220175

PCT Pub. Date: Oct. 20, 2022

(65) Prior Publication Data

US 2024/0218574 A1 Jul. 4, 2024

(30) Foreign Application Priority Data

Apr. 15, 2021 (JP) ..... 2021-068858

(51) Int. Cl.
*D03D 27/08* (2006.01)
*D02G 3/04* (2006.01)
(Continued)

(52) U.S. Cl.
CPC ..... *D03D 27/08* (2013.01); *D02G 3/04* (2013.01); *D02G 3/28* (2013.01); *D02G 3/34* (2013.01);
(Continued)

(58) Field of Classification Search
CPC .... D03D 27/08; D03D 13/008; D03D 15/217; D03D 15/47; D03D 15/49; D02G 3/04;
(Continued)

(56) References Cited

U.S. PATENT DOCUMENTS 3,912,572 A 10/1975 Lacon
4,059,873 A * 11/1977 Nelson ..... D02J 1/08 28/271
(Continued)

FOREIGN PATENT DOCUMENTS

JP 51-12747 7/1949
JP S49-116376 A 11/1974
(Continued)

OTHER PUBLICATIONS

Eisuke, H., "Structure and Properties of Sirospun Yarn and Physical Properties and Texture of Cloth Using the Same", *Journal of The Textile Machinery Society of Japan*, 1985, vol. 3889 (2), pp. 108-110.

*Primary Examiner* — Robert H Muromoto, Jr.
(74) *Attorney, Agent, or Firm* — Sterne, Kessler, Goldstein & Fox P.L.L.C.

(57) ABSTRACT

There are provided a towel cloth which has a bulky and fluffy texture, is less likely to undergo fluff dropping, and is excellent in water absorbency, and a manufacturing method thereof. For a towel cloth including a ground weave including a warp ground yarn and a weft ground yarn crossing each other therein, and a pile yarn locked to the ground weave, at least one of the warp ground yarn, the weft ground yarn, and the pile yarn is formed of a twisted union finished yarn, and the twisted union finished yarn includes a twisted union yarn including two or more rovings twisted in a primary twisting direction as a single yarn, one of the rovings having an even twist, and at least another of the rovings partially having a
(Continued)

twist with irregular strand length and twisting angle, the twisted union yarn undergoing fiber opening and being puffy.

9 Claims, 2 Drawing Sheets

(51) Int. Cl.

| | |
|---|---|
| ***D02G 3/28*** | (2006.01) |
| ***D02G 3/34*** | (2006.01) |
| ***D03D 13/00*** | (2006.01) |
| ***D03D 15/217*** | (2021.01) |
| ***D03D 15/47*** | (2021.01) |
| ***D03D 15/49*** | (2021.01) |

(52) U.S. Cl.
CPC ..... *D03D 13/008* (2013.01); *D03D 15/217* (2021.01); *D03D 15/47* (2021.01); *D03D 15/49* (2021.01); *D10B 2201/02* (2013.01); *D10B 2401/022* (2013.01)

(58) Field of Classification Search
CPC ..... D02G 3/28; D02G 3/34; D10B 2201/02; D10B 2401/022
See application file for complete search history.

(56) References Cited

U.S. PATENT DOCUMENTS

| | | | | |
|---|---|---|---|---|
| 4,809,493 | A * | 3/1989 | Genba | A61F 13/4902 57/252 |
| 11,732,388 | B2 * | 8/2023 | Wang | D03D 15/217 139/5 |
| 11,946,172 | B2 * | 4/2024 | Kanematsu | H10N 30/30 |
| 2020/0362485 | A1 * | 11/2020 | Kanematsu | D02G 3/04 |
| 2021/0189609 | A1 * | 6/2021 | Patrick | D02G 3/443 |
| 2021/0348310 | A1 * | 11/2021 | Bivens | D02G 3/38 |
| 2022/0064827 | A1 * | 3/2022 | Wang | D01H 13/04 |

FOREIGN PATENT DOCUMENTS

| | | | |
|---|---|---|---|
| JP | S53-098442 | A | 8/1978 |
| JP | S64-33227 | | 2/1989 |
| JP | 2000-119927 | A | 4/2000 |
| JP | 2005-200790 | | 7/2005 |
| JP | 2008-025055 | A | 2/2008 |
| JP | 2014-025273 | A | 2/2014 |
| JP | 2017-042370 | | 3/2017 |
| JP | 2021-006671 | | 1/2021 |
| JP | 2021-050462 | | 4/2021 |

* cited by examiner

TOWEL CLOTH AND MANUFACTURING METHOD THEREOF

TECHNICAL FIELD

The present invention relates to a towel cloth and a manufacturing method thereof. More particularly, it relates to a towel cloth which has a bulky and fluffy texture, is less likely to undergo fluff dropping, and is excellent in water absorbency, and a manufacturing method thereof.

BACKGROUND ART

In recent years, with diversified consumer preferences, the texture and high functionality of a towel have been demanded. Out of these, for the texture, there is a high need for a high quality towel which is especially bulky, and has a fluffy feel. In order to allow such a fluffy feel to be exhibited, with a towel woven fabric having a cross sectional structure in which a pile yarn is locked to the ground weave including a warp ground yarn and a weft ground yarn crossing each other therein, there are the method in which the pile length of the pile yarn is increased, thereby enhancing the softness of the pile; and the method in which softening is achieved by using a yarn of a fine count for a pile yarn. However, with either method, although a soft touch can be obtained, the resilience is poor, and a bulky and fluffy texture cannot be obtained.

Further, for fluff dropping of a towel, for example, when the towel is washed together with other clothes, or the laundry is folded up, fluffs of the towel are attached. This may cause the experience that the fluffs stand out when the clothes are worn. In contrast, there is the method in which, during manufacturing processing of the towel cloth, the fluffs on the surface of the woven fabric are singed, thereby reducing dropping of fluffs. However, the fluffs of the pile yarn are reduced, resulting in a rough texture of the towel cloth, which is difficult to cope with.

Further, the water absorbency is one of the large features of a cotton towel. However, for example, when the moisture is wiped off upon sweating or right after taking a bath, the moisture may not be wiped off sufficiently. The tendency is often observed particularly for the one including a thin towel cloth, and having a less bulky and flat texture. This is due to the fact that the towel is poor in wiping water absorption function performance of quickly absorbing a large amount of moisture attached on the skin, which is the problem to be solved.

Against such a problem, there have been proposed various types of twist yarn processing using a ring spun yarn which has gone common mainstream from the technical viewpoint. As the method for imparting the bulkiness, there is the method in which a hard twisted yarn of a cellulose type fiber is starched, and is subjected to a liquid ammonium treatment and a steam treatment; then, to the hard twisted yarn, a water-soluble yarn twisted in the opposite direction to the direction of twisting of the hard twisted yarn is plied; and then, the water-soluble yarn in the hard twisted yarn is dissolved and removed, resulting in a bulky cellulose type fiber (Patent Document 1). Whereas, there are the spun yarn and the woven/knitted fabric of this method (Patent Document 2). Further, there has been proposed processing of a spun yarn in which a single yarn of a spun yarn is starched without using the water-soluble yarn for reduction of costs, and is dried, followed by untwisting in the opposite direction to that of the spun yarn (Patent Document 3). Further, in order to obtain a beautiful stitch style knitted fabric, there has been proposed a high twist tone processed yarn of a synthetic fabric including one single yarn continuously fuse-bonded with the S twist and Z twist alternately twisted along the yarn axis (Patent Document 4). Furthermore, for obtaining a cool contact feeling, a twisted union yarn has been proposed obtained in the following manner: to a single yarn of a spun yarn of a natural fiber or a synthetic fiber, a thermoplastic synthetic fiber multifilament yarn is subjected to false-twist crimp processing in the opposite direction to that of the spun yarn single yarn; then, the false twisted yarn and the spun yarn are combined, and twisting is performed in the same direction as that of the spun yarn single yarn (Patent Document 5).

Further, conventionally, in contrast to the ring spun yarn for which a single yarn is formed by twisting one cotton roving as conventionally widely performed, there is a twisted union yarn (Sirospun) for which one roving and another roving are aligned in parallel with each other, and the two yarns are combined and twisted, thereby forming a single yarn. The following is introduced: the twisted union yarn is higher in strength elongation of yarn than the ring spun yarn; for this reason, yarn breakage of a warp is not caused, so that the weavability can be improved (Non-Patent Document 1).

However, the technology of plying and dissolving and removing the water-soluble yarn twisted in the opposite direction to the direction of twisting of the hard twisted yarn of Patent Document 1 or Patent Document 2 involves the dissolution removal step of a water-soluble yarn and the disposal treatment step of a solution, resulting in a higher manufacturing cost. Particularly, the disposal cost of the dissolving solution is too large to ignore. The single yarn is untwisted after starching in Patent Document 3, so that the starching step causes an increase in manufacturing cost. In Patent Document 4, S and Z twists are fuse-bonded alternately in the length direction of one yarn, and hence the fuse-bonding step causes an increase in manufacturing cost. In Patent Document 5, a spun yarn single yarn and a thermoplastic synthetic fiber multifilament yarn are subjected to false-twist crimp processing, and the like in the opposite direction to that of the spun yarn single yarn. However, the steps are complicated and the manufacturing cost is high. The spun plied yarn introduced in Non-Patent Document 1 is hard and rigid, and has a strong tightened feel, and lacks in puffy feel. For this reason, even when the yarn is adopted for a pile yarn of a towel as it is, a texture of a bulky fluffy feel cannot be provided. When the number of twists of the spun plied yarn is reduced in order to allow puffiness to be exhibited, puffiness is exhibited to a certain degree, however, a large number of long fluffs are produced, so that the dropping of fluffs of the product cannot be improved.

As described up to this point, in actuality, none of known technologies specifying a towel cloth having a bulky and fluffy texture, less likely to undergo dropping of fluffs, and excellent in water absorbency, and a manufacturing method thereof have been found.

CITATION LIST

Patent Document

Patent Document 1: Japanese patent No. 2000-119927
Patent Document 2: Patent Publication JP-A 2008-25055
Patent Document 3: Patent Publication JP-A 2014-25273
Patent Document 4: Patent Publication JP-A S53-98442
Patent Document 5: Japanese Utility Model Application Publication No. S51-12747

Non-Patent Document

Non-Patent Document 1: Journal of The Textile Machinery Society of Japan, 1985, VOL 3889 (2), p 108-110, Structure and properties of Sirospun yarn and physical properties and texture of cloth using the same, written by Hasegawa Eisuke

SUMMARY

Technical Problem

It is an object of the present invention to provide a towel cloth for solving the problem, and having a bulky and fluffy texture, less likely to undergo dropping of fluffs, and excellent in water absorbency, and a manufacturing method thereof.

Solution to Problem

In order to solve the problem, a towel cloth of one aspect of the present invention is a towel cloth including:

a ground weave including a warp ground yarn and a weft ground yarn crossing each other therein, and a pile yarn locked to the ground weave, at least one of the warp ground yarn, the weft ground yarn, and the pile yarn being formed of a twisted union finished yarn, and the twisted union finished yarn including a spun plied yarn including two or more rovings twisted in a primary twisting direction as a single yarn, one of the rovings having an even twist, and at least another of the rovings partially having a true twist with irregular strand length and twisting angle, the twisted union yarn undergoing fiber opening and being puffy.

It is preferable that the twisted union yarn includes a large number of strong tangling parts at the irregular true twist sites, and the spun plied finished yarn has fine fluffs appearing from the strong tangling parts at a surface of the spun plied finished yarn. As a result of this, fine fluffs are allowed to come out from the strong tangling parts. For this reason, the towel cloth has a fluff drop resistance, so that the fluff dropping property can be remarkably improved.

It is preferable that the twisted union-finished yarn is configured by being untwisted in the opposite direction within the range of 5 to 80% based on the number of primary twists. As a result of this, as compared with the case where the towel cloth does not have the present configuration, the towel cloth can implement a puffy texture, which is also preferable in terms of water absorbency.

It is preferable that the yarn includes a cotton and a synthetic fiber with mixing ratios of 40 wt % or more of the cotton and less than 60 wt % of the synthetic fiber. As a result of this, as compared with the case where the towel cloth does not have the present configuration, the quick dryability and the dimensional stability of a synthetic fiber can be imparted in a better balanced manner while keeping the water absorbency and the hygroscopicity of the cotton.

It is preferable that a yarn count of the twisted union finished yarn is 5 to 300. As a result of this, as compared with the case where the towel cloth does not have the present configuration, the towel cloth can be adapted to a thick fabric towel cloth to a thin fabric towel cloth.

It is preferable that a basis weight of the towel cloth is 80 to 1000 g/m$^2$. As a result of this, as compared with the case where the towel cloth does not have the present configuration, the features of the present invention such as the puffy texture, the fluff dropping performance, and the water absorbency can be exhibited by the towel cloth for various uses.

In order to solve the problem, a method for manufacturing a towel cloth in accordance with one aspect of the present invention is a method for manufacturing a towel cloth including a ground weave including a warp ground yarn and a weft ground yarn crossing each other therein, and a pile yarn locked to the ground weave, at least one of the warp ground yarn, the weft ground yarn, and the pile yarn being formed of a twisted union-finished yarn. With the method for manufacturing a towel cloth, the twisted union finished yarn is manufactured by the steps of:

paralleling two or more rovings in the same direction, and primarily twisting the rovings as a single yarn, thereby forming a twisted union yarn; and finally twisting the twisted union yarn in the opposite direction to a primary twisting direction for untwisting, and forming a twisted union finished yarn.

It is preferable that the step of forming the twisted union finished yarn includes scratching the twisted union yarn simultaneously with untwisting of the twisted union yarn. As a result of this, untwisting and scratching can be carried out in one step. For this reason, it is possible to implement a puffy texture, the water absorbency, and the fluff dropping performance at a low manufacturing cost.

It is preferable that the step of forming the twisted union finished yarn includes untwisting the twisted union yarn at a revolution speed within the range of 5 to 80% of the revolution speed of primary twisting. As a result of this, as compared with the case where the towel cloth does not have the present configuration, it is possible to implement a puffy texture, the fluff dropping performance, and the water absorbency in a well-balanced manner.

Advantageous Effects of Invention

In accordance with the present invention, it is possible to provide a towel cloth having a bulky and fluffy texture, less likely to undergo fluff dropping, and excellent in water absorbency, and the manufacturing method thereof.

BRIEF DESCRIPTION OF DRAWINGS

FIG. 2 is an enlarged photograph of a yarn single yarn of Example.

DESCRIPTION OF EMBODIMENTS (Structure of Towel Cloth)

Figure 1:
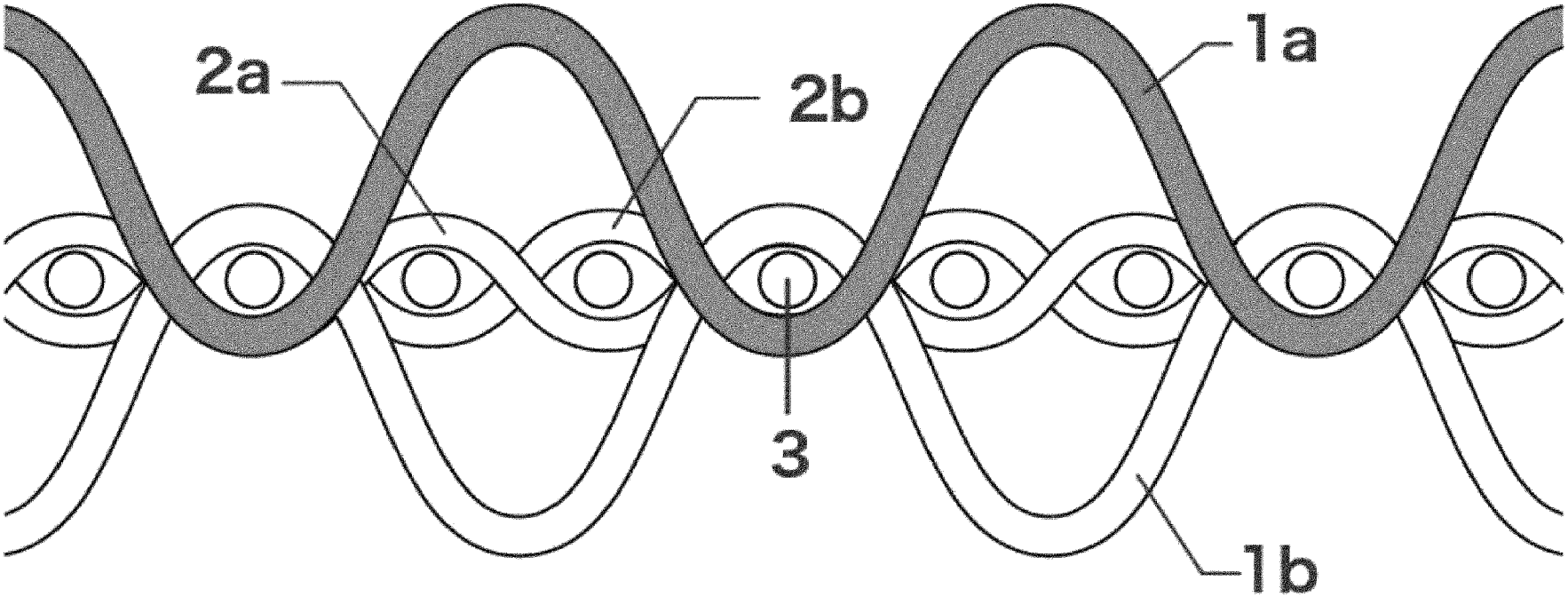
FIG. 1 is a schematic view showing a cross sectional structure of a towel cloth in accordance with one embodiment of the present invention.

Below, one embodiment of the present invention will be described by reference to the accompanying drawings. FIG. 1 is a schematic view showing a cross sectional structure of a towel cloth in accordance with the present embodiment. The towel cloth is configured such that pile yarns 1*a* and 1*b* are locked to a ground weave including warp ground yarns 2*a* and 2*b* and a weft ground yarn 3 crossing each other therein as shown in FIG. 1. Herein, the top of FIG. 1 is the surface side of the towel cloth (or the ground weave), and 1*a* is the pile yarn on the front side, and 1*b* is the pile yarn on the back side. In the present embodiment, for the pile yarns 1*a* and 1*b*, the twisted union finished yarn obtained by subjecting the twisted union yarn described below to untwisting processing.

(Structure of Twisted Union Finished Yarn)

The twisted union yarn to be used for the pile yarns 1*a* and 1*b* is formed by primarily twisting two rovings of cotton or the like aligned in parallel with one another in the primary twisting direction as a single yarn. At this step, while one roving is evenly twisted, the other roving is varied in strand length and twisting angle. Thus, the formed twisted union yarn becomes a single yarn in a state like a two ply yarn slightly subjected to true twisting in places. For this reason, the twisted union yarn has a distorted twisted structure in which a large number of irregular twists and strong tangling parts are present in the single yarn. Due to the distorted twisted structure, as compared with the single yarn of a ring spun yarn having a conventional even twisted structure, the twisted union yarn has an advantage capable of providing a woven fabric having a higher strength elongation of the yarn, less undergoing yarn breakage during weaving, and using a single yarn as a warp. On the other hand, the twisted union yarn also has a disadvantage that the yarn is hard and rigid, producing a strong tightened feel, and lacks in puffy feel.

For the twisted union yarn in accordance with the present embodiment, two or more rovings are paralleled, and are subjected to primary twisting processing as a single yarn. However, in terms of the stability of the quality of the yarn, and the supply facility of the roving roll, as described in the present embodiment, for the twisted union yarn, preferably, two rovings are aligned in parallel with one another, and are subjected to primary twisting processing as one single yarn. When both the two rovings to be paralleled are cotton, the towel cloth using this can provide a dry touch peculiar to cotton, and is excellent in water absorbency and hygroscopicity. It is also preferable that one roving cotton yarn and one synthetic fiber yarn of filament or staple such as polyester or polyamide may be aligned in parallel and twisted in single yarn. In this case, by mixing cotton and a synthetic fiber within the range of 40 wt % or more of cotton and less than 60 wt % of synthetic fiber, it is possible to obtain a towel cloth having the quick dryability and the size stability of the synthetic fiber in a well-balanced manner while keeping the water absorbency and the hygroscopicity of a cotton. Incidentally, a staple fiber such as rayon, cupra, acrylic, or wool may be blended in a small amount in the cotton. The towel cloth using rayon or cupra can acquire hygroscopicity, and the towel cloth using acrylic or wool can acquire heat retaining property.

Subsequently, the twisted union yarn is untwisted while scratching the twisted union yarn using a belt made of rubber, thereby revealing fluffs finely raised on the surface of the yarn. Simultaneously, physical fiber opening is caused, thereby puffing the yarn. As a result, a twisted union finished yarn is formed. The revealed fine fluffs are taken out from the strong tangling part of the yarn, and are raised. Accordingly, the twisted union finished yarn has a fluff dropping resistance, so that the fluff dropping property is remarkably improved. Further, simultaneously, the yarn is opened by untwisting, and becomes puffy. This provides a bulky and fluffy texture. In addition, the water absorption area becomes wider by fiber opening, resulting in excellent water absorbency.

For the twisted union finished yarn in accordance with the present embodiment, the single yarn of the twisted union yarn obtained by primarily twisting two or more rovings is untwisted by being finally twisted in the opposite direction to the primary twisting direction. The untwisting ratio at the step is preferably within the range of 5 to 80% based on the revolution speed of primary twisting in terms of the puffy texture, the fluff dropping property, and the water absorbency. Further, the one within the range of 10 to 65% is in particular preferable. Incidentally, the one of less than 5% is poor in texture and water absorbency. Whereas, the one of more than 80% is weakened in tangling, so that the fluff dropping property and yarn breakage are caused. For this reason, both cases are not preferable.

The yarn count of the twisted union finished yarn is preferably 5 to 300, because the yarn can be adapted to from a thick fabric towel cloth to a thin fabric one. Particularly, in order to obtain a puffy and resilient texture, counts 16 to 100 are preferable. Further, a twisted union finished yarn with an extremely fine count corresponding to 200 which could not have been conventionally spun with 100% cotton can be manufactured with a method for manufacturing a towel cloth in accordance with the present embodiment described below. For example, a roving equivalent to cotton with a count of 80 and a filament fiber (multifilament) of 44-denier synthetic fiber are paralleled, and conjugated. This results in a single yarn with a count of 200 which could not have been attained heretofore, so that a very light-weight towel cloth can be obtained. Incidentally, the one with a yarn count of lower than 5 has a hard feeling of the cloth, and becomes very thick. Whereas, the one with a fine yarn count of more than 300 becomes too soft, and becomes less resilient. For these reasons, none of the cases are not preferable.

Then, when the towel cloth in accordance with the present embodiment has a basis weight within the range of 80 to 1000 g/m$^2$, it can exhibit the features of the present embodiment such as the puffy texture, fluff dropping performance, and the water absorbency, and hence is preferable. Still further, as the basis weight of the towel cloth, further specific examples will be mentioned. For a thin cloth, the basis weight is preferably 100 to 250 g/m$^2$; for a medium thick cloth, the basis weight is preferably 250 to 500 g/m$^2$; and for a thick cloth, the basis weight is preferably 500 to 1000 g/m$^2$. Incidentally, the one with a basis weight of less than 100 g/m$^2$ is thin, and is not bulky. Whereas, the one with a basis weight of more than 1000 g/m$^2$ is too thick and heavy. None of the cases are not preferable.

(Method for Manufacturing Towel Cloth)

The towel cloth in accordance with the present embodiment is a towel cloth including a ground weave including a warp ground yarn and a weft ground yarn crossing each other therein, and a pile yarn locked to the ground weave, and is manufactured by a manufacturing method including a step of paralleling two rovings in the same direction, and primarily twisting the rovings as a single yarn; a step of finally twisting the single yarn in the opposite direction to the primary twisting direction for untwisting, and forming a twisted union finished yarn; and a step of locking a pile yarn to the ground weave. Below, respective steps will be successively described.

First, at the primary twisting step, two rovings of cotton or the like are aligned in parallel with each other. The two rovings are primarily twisted in the primary twisting direction as a single yarn, thereby forming a twisted union yarn. Subsequently, at the twisted union finished yarn forming step, the spun plied yarn formed by primary twisting is untwisted in the opposite direction within the range of 5 to 80% using a rotary tool. Herein, although the rotary tool for use in the untwisting has no particular restriction, a rotary belt, a rotary ring, a rotary roll, or the like, having a material with a high frictional force with a yarn on the surface, and capable of elaborately performing untwisting in an intimate contact manner with the yarn without letting the yarn slip is preferable. As the material of the contact portion, rubber, polyurethane resin, silicone resin, or the like is preferable. In terms of the versatility, the durability, and the like, a rotary belt made of rubber is in particular preferable. With the specific untwisting method at this step, a rotary belt is brought into intimate contact with the (thickest part of the yarn) in the direction perpendicular to the running twisted union yarn, and the rotary belt is caused to perform scratching in the opposite direction to the primary twisting direction, thereby untwisting the twisted union yarn, resulting in a twisted union finished yarn. As a result of this, the twisted union finished yarn undergoes exhibition of fine fluffs due to scratching and puffing of the yarn due to fiber opening. This can provide a bulky and fluffy texture, and the fluff droppability improvement, and the excellent water absorbency of the towel cloth of the present embodiment. Incidentally, primary twisting processing and untwisting processing may be carried out in separate steps. However, the method for coupling the primary twisting processing and the untwisting processing, and successively performing the steps as one step is in particular preferable in terms of the processing efficiency and the stability of the yarn quality.

Then, the resulting twisted union finished yarn is used as a pile yarn, and this is locked to the ground weave including a warp ground yarn and a weft ground yarn crossing each other therein, which is woven into a towel cloth. Incidentally, the twisted union finished yarn is applicable to any one of, or both of the warp ground yarn and the weft ground yarn other than to the pile yarn. Based on such a premise, weaving is performed by appropriately designing the pile length, the vertical, horizontal densities, the basis weight, and the like according to the intended purpose of the towel. The quick dryability and the water absorbency are not determined by the basis weight, and the rate is determined by the mixing ratios of synthetic fiber/cotton. For this reason, weaving is not designed by the basis weight, or the like, but is designed by the mixing ratio of the twisted union yarn. For example, when the importance is attached to the quick dryability, the mixing ratio of the synthetic fiber of the pile yarn and the ground yarn of the twisted union finished yarn is increased. As a result of this, the draining property is improved, resulting in an improved quick dryability. On the other hand, when the importance is attached to the water absorbency, a synthetic fiber does not absorb water, and a cotton absorbs water. For this reason, the mixing ratio of the cotton of the pile yarn and the ground yarn of the twisted union finished yarn is increased.

Then, the grey fabric of such a woven towel cloth is subjected to dyeing processing. For the dyeing processing, desizing, alkali scouring, and hydrogen peroxide bleaching are performed according to the steps commonly performed for a cotton towel, and dyeing is performed with a reactive dye, and setting is performed by a pin tenter for finishing. When finishing is achieved as a white cloth, the dyeing step is omitted, and scouring, bleaching, and setting are performed for finishing. Incidentally, in the case where a synthetic fiber is blended in a cotton, when the synthetic fiber is polyester, dyeing is performed at 130° ° C. with a disperse dye. Then, the cotton side is dyed with a reactive dye at 80° C. Further, in the case of a nylon blend, dyeing is performed with an acidic dye, and then, cotton is dyed, so that each is set and finished. Incidentally, when such a synthetic fiber is blended in a cotton, the synthetic fiber is dyed with a disperse dye, and the cotton is dyed with a reactive dye. Accordingly, dyeing is performed in a double dyeing step. In order to obtain versatile color designability, union color dyeing in which the colors of the disperse dye and the reactive dye are made equal, different color dyeing in which dyeing is performed as completely different colors, and light shade dyeing in which colors are developed intended for the similar color difference (chambray) are appropriately selected.

EXAMPLES

Below, the present embodiment will be described in details by way of Examples. However, the present invention is not necessarily limited thereto.

[Evaluation Method]

(1) Evaluation of Twisted Union Yarn for Use in Pile of Towel

The outward appearance of the fluff of the yarn and the puffiness of the yarn were photographed (microscope manufactured by KEYENCE Co., Ltd., a magnification of 50 times). For the thickness of the yarn, the diameter (mm) of the yarn was measured from the photograph. The yarn becomes puffier, and more favorable with a decrease in length of the fluff of the yarn and with an increase in thickness of the yarn.

(2) Evaluation of Bulkiness of Towel Cloth

The bulkiness is expressed as the volume per one gram of a towel cloth, and was evaluated by the following degree of bulkiness ($cm^3/g$). The thickness was measured according to the JIS L-1096 method. The larger the value is, the more the yarn is bulky, and favorable. Degree of bulkiness ($cm^3/g$) =thickness (mm)/basis weight ($g/m^2$)×1000

(3) Evaluation of Fluffy Texture of Towel Cloth

The fluffy feel has a correlation with the compression work amount. For this reason, the compression work amount was measured for evaluation. When the compression work amount was measured with a towel cloth not folded, and kept in a flat state, a compression measuring instrument: KES-FB3-A (manufactured by KATO TECH CO., LTD.) was used. When the compression work amount was measured with a towel cloth folded into two, a compression measuring instrument: KES-G5 (manufactured by KATO TECH CO., LTD.) was used. Then, the towel cloth was compressed at a constant speed, thereby determining the compression work amount: WC=($gf \cdot cm^2$). The larger the value in terms of (energy) upon compression of the cloth is, the more the towel is compressed, resulting in a larger puffiness=higher fluffy feel, which is more favorable. The measurements were performed at five sites, and the average value thereof was used. Further, the measurements were performed in two ways for the case of one towel cloth and the case of the towel cloth folded into two.

(4) Evaluation of Fluff Dropping Property of Towel Cloth

The fluff dropping due to washing was measured according to the JIS L-0217, 103 method. The fluff dropping rate (%) was determined by the following equation. The smaller the value is, the less fluff dropping is caused, which is more favorable. The measurements were performed with five towel cloths, and the average value thereof was used.

Fluff dropping rate (%)=(weight (g1) of fluffs which have fallen off after washing/(weight (g0) of towel before washing)×100

(5) Evaluation of Water Absorbency of Towel Cloth

The water absorbency of a towel cloth is the performance when the towel cloth wipes off the moisture just after taking a bath, or at other times, and was evaluated according to the improved Larose test method of the JIS L-1907 method. The summary of the test is as follows: the towel is applied with a load; and the sum of the water absorption rate and the absorbed moisture amount of the moisture diffused in the towel is expressed as the water absorption index by the defined expression. A towel cloth with a larger index absorbs the moisture left on the skin more quickly and in a larger amount, and is more favorable. The criteria of the index are as follows: 700 or more: the water absorbency is very excellent, less than 500: good, less than 300: average, and less than 100: inferior. The measurements were performed at five sites, and the average value thereof was used. Further, the measurements were performed in two ways for a finished product of a towel cloth (before washing) and after washing.

Example 1

(1) Manufacturing Method and Evaluation Method of Towel Cloth

A. Processing of Twisted Union Finished Yarn

Figure 2A:
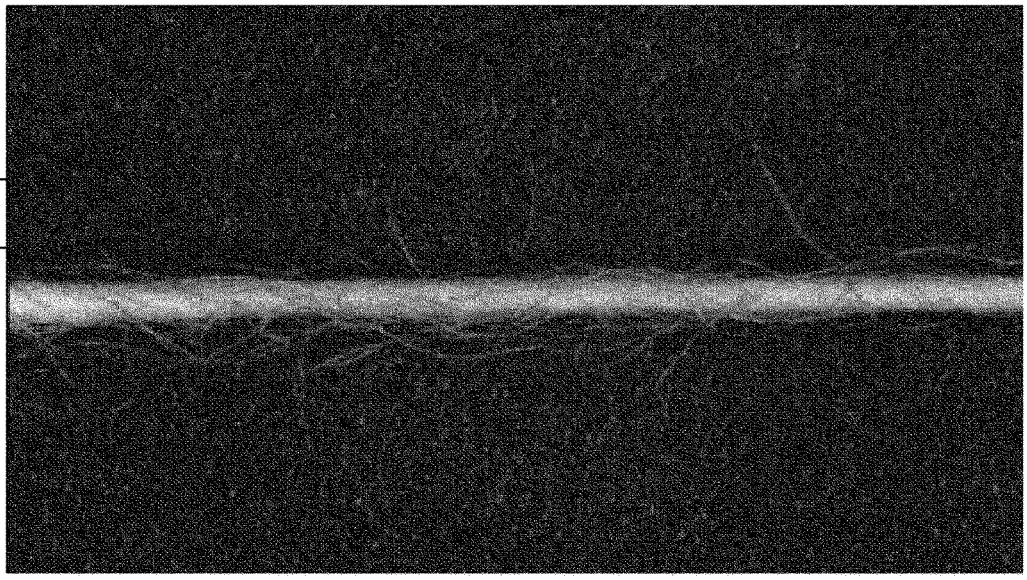
FIG. 2A shows an enlarged photograph of a twisted union finished yarn single yarn of Example 1.

One roving equivalent to a cotton with a count of 32 was placed on each of the left and right sides as a pile yarn. These were combined in two, and were primarily twisted at 650 times per meter in the Z direction (left twisting), thereby forming a twisted union yarn of a 16-count single yarn (650 twists/m, Z twisting). Subsequently, the primarily twisted single yarn was finally twisted at 150 twists/m by S twist (right twist) in the opposite direction to that of the single yarn by a belt made of rubber, and was untwisted while being scratched (untwisting rate: 23%). This resulted in a twisted union finished yarn of a 16-count single yarn untwisted and Z twisted at 500 twists/m. Herein, FIG. 2 is an enlarged photograph of the yarn single yarn of Example. FIG. 2A shows an enlarged photograph of the untwisted twisted union finished yarn of Example 1. FIG. 2A is an enlarged photograph of a twisted union finished yarn single yarn obtained by finally twisting and untwisting the twisted union yarn single yarn primarily twisted by Z twisting at 650 twists/m with twisting at 150 twists/m by S twist (right twist) in the opposite direction to that of the single yarn, namely, by Z twisting at 500 twists/m. From the photograph of FIG. 2A, the outward appearance of the fluff of the twisted union finished yarn and the diameter of the yarn were measured and evaluated.

B. Processing of Woven Fabric

Then, using the untwisted twisted union finished yarn of the 16-count single yarn for the piles on the front and the rear of the woven fabric, using a 16-count single yarn of a ring spun yarn for the warp ground yarn, and using a 20-count single yarn of a ring spun yarn for the weft ground yarn, the pile yarn was locked to such a ground weave, thereby performing weaving into a 100% cotton towel cloth with a vertical density of 60 yarns/inch and a horizontal density of 42 yarns/inch. The woven grey fabric was subjected to desizing, scouring, bleaching processing, and setting according to the normal method of cotton processing, thereby performing finishing in white cloth. The finished towel cloth had a thickness of 4.45 mm and a basis weight of 422 g/m$^2$. For the evaluation of the finished towel cloth, according to the evaluation method described above, the degree of bulkiness, the physical amount of the fluffy texture, the ease for fluffs to drop, and the water absorbency of the towel cloth were respectively evaluated. The evaluation results are shown in Table 1.

Comparative Example 1

Figure 2B:
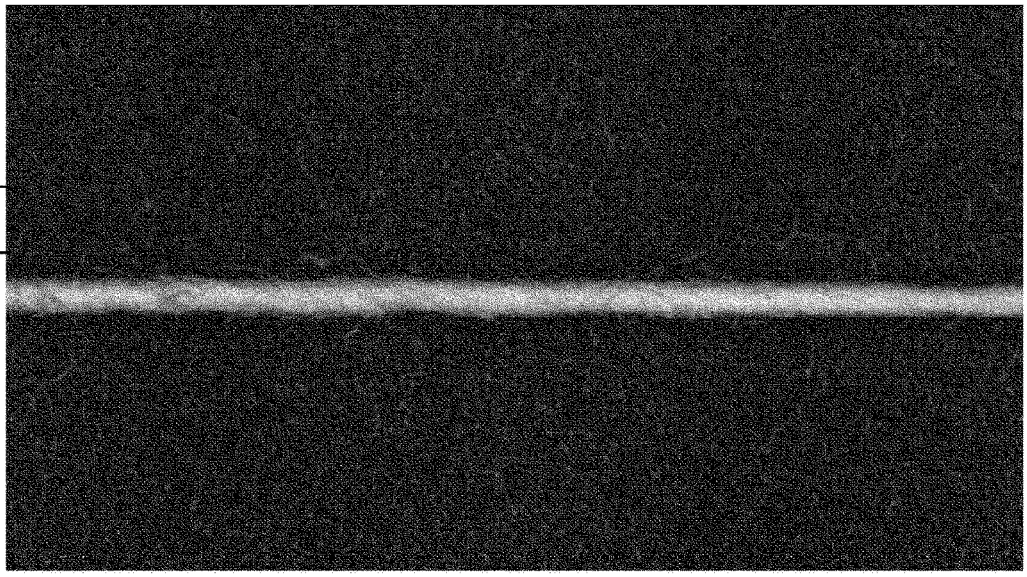
FIG. 2B shows an enlarged photograph of a twisted union yarn single yarn of Comparative Example 1.

A twisted union yarn of a 16-count single yarn with 600 twists/m by Z twist was formed, and this was woven, processed, and finished in accordance with Example 1, except that this yarn was used for a pile yarn as it was without being subjected to untwisting processing. FIG. 2B shows an enlarged view of the untwisted twisted union yarn single yarn of Comparative Example 1. FIG. 2B is an enlarged photograph of the twisted union yarn single yarn twisted at 650 twists/m by Z twisting, but not followed by untwisting. From the twisted yarn photograph of FIG. 2B, the outward appearance of the fluff of the twisted union yarn and the diameter of the yarn were measured and evaluated. The thickness of the finished towel cloth was 4.01 mm, and the basis weight was 433 g/m$^2$. The evaluation was carried out in the same manner as in Example 1. The results are shown together in Table 1.

Comparative Example 2

Figure 2C:
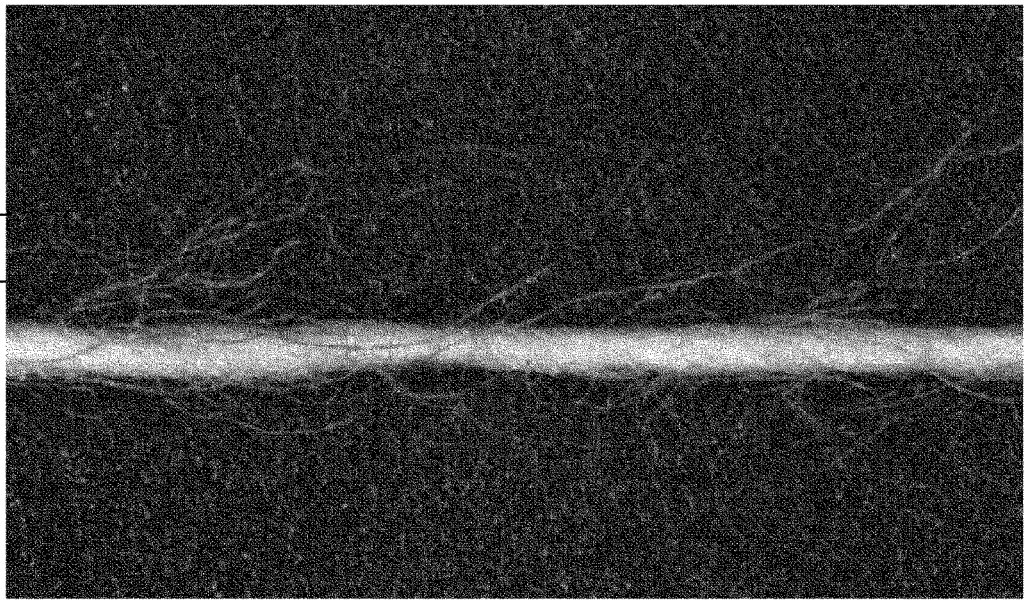
FIG. 2C shows an enlarged photograph of a twisted union yarn single yarn of Comparative Example 2.

A twisted union yarn of a 16-count single yarn with 500 twists/m by Z twist was formed, and this was woven, processed, and finished in accordance with Example 1, except that this yarn was used for a pile yarn as it was without being subjected to untwisting processing. FIG. 2C shows an enlarged view of the untwisted twisted union yarn single yarn of Comparative Example 2. FIG. 2C is an enlarged photograph of the twisted union yarn single yarn twisted at 500 twists/m by Z twisting, but not followed by untwisting. From the twisted yarn photograph of FIG. 2C, the outward appearance of the fluff of the twisted union yarn and the diameter of the yarn were measured and evaluated. The thickness of the finished towel cloth was 3.96 mm, and the basis weight was 444 g/m$^2$. The evaluation was carried out in the same manner as in Example 1. The results are shown together in Table 1.

TABLE 1

| | Degree of bulkiness (cm$^3$/g) | Compression work amount WC (gf · cm$^2$) *flat state | Compression work amount WC (gf · cm$^2$) *bi-folded state | Fluff dropping rate of washing (%) | Water absorption index before washing | Water absorption index after washing |
|---|---|---|---|---|---|---|
| Example 1 | 10.55 | 5.80 | 12.05 | 0.034 | 562 | 779 |
| Comparative Example 1 | 9.26 | 3.77 | 8.82 | 0.045 | 117 | 555 |
| Comparative Example 2 | 8.92 | 3.65 | 9.36 | 0.046 | 159 | 643 |

(2) Evaluation Results

A. Evaluation of Twisted Union Yarn

The yarn of Example 1 was, in FIG. 2A, a twisted union finished yarn with fine fluffs, a thickness of the yarn of 6.0 mm in diameter, and being puffy. On the other hand, the yarn of FIG. 2B of Comparative Example 1 was a twisted union yarn with almost no fluffs, a thickness of the yarn of 5.0 mm in diameter, without puffiness, and being rigid. Whereas, the yarn of FIG. 2C of Comparative Example 2 was a twisted union yarn with a thickness of the yarn of 7.5 mm in diameter, and being puffy, but having long and dense fluffs, and tending to undergo fluff dropping.

B. Evaluation of Woven Fabric

As apparent from Table 1, the towel cloth of Example 1 was a wonderful white towel cloth excellent in bulkiness, having a fluffy texture, less likely to undergo fluff dropping, and having a high water absorbency. Particularly, the degree of bulkiness was 10.55 $cm^3/g$, a 14% to 18% increase, and the compression work amount was 5.80 $gf \cdot cm^2$, 1.5 to 1.6 times, each showing a large increase relative to Comparative Example 1 and Comparative Example 2. This supported the high bulkiness and the fluffy-texture. Further, the fluff dropping rate during washing was 0.034%, indicating that the fluff dropping was less likely to be caused by 25% to 26% based on those of Comparative Example 1 and Comparative Example 2. Furthermore, the wiping water absorption index was 4.8 to 3.5 times that of the same Comparative Example, which was at a level as good as 500 or more. After washing, it was 1.4 to 1.2 times, which as at a level as very excellent as 700 or more. Thus, the towel cloth was a white towel cloth exhibiting a large water absorbency. Incidentally, there was no particular problem with manufacturing of yarn processing, weaving, and finish processing, so that processing could be performed smoothly.

The finished towel was sewed into a hand towel, and a test for practical use was carried out. First, for the texture, the bulky and fluffy texture was comfortable, and the towel was full of a sense of high quality. Further, after wiping the skin upon taking a bath, the wiping property of the moisture was good, and the skin was smooth, and refreshing. Further, washing hardly causes the fluffs of the towel to be deposited on other clothes, implementing a very comfortable hand towel. On the other hand, Comparative Example 1 and Comparative Example 2 were inferior as a whole, less bulky, and lacked a fluffy texture as compared with Example 1. Further, the towels were ordinary white towels tending to undergo fluff dropping, and also inferior in water absorbency.

Example 2

A. Yarn Twisting Processing

As a pile yarn, a twisted union yarn of a single yarn of a 20-count cotton primarily twisted by Z twist at 580 twists/m according to the method of Example 1 was formed. Then, the primarily twisted single yarn was finally twisted at 155 twists/m by S twist (right twist) in the opposite direction to that of the single yarn using the same belt made of rubber as that of Example 1, for untwisting processing (untwisting rate: 27%). This resulted in a twisted union finished yarn of a 20-count single yarn untwisted at 425 twists/m by Z twisting (580 twists/m Z to 155 twists/m, S untwisting to 425/m Z).

B. Processing of Woven Fabric

Then, using the untwisted twisted union finished yarn of a 20-count single yarn for the pile yarns on the front and the rear of the woven fabric, using a 16-count single yarn of a ring spun yarn of cotton for both the warp ground yarn and the weft ground yarn, weaving was performed into a 100% cotton towel cloth with a vertical density of 60 yarns/inch and a horizontal density of 42 yarns/inch. The woven grey fabric was subjected to desizing scouring, and bleaching processing, and was dyed with a dark blue reactive dye at 80° C. for 40 minutes, and set and finished. The finished towel cloth had a thickness of 3.99 mm, a basis weight of 411 $g/m^2$, and a degree of bulkiness of 9.71 $cm^3/g$.

Comparative Example 3

Weaving was performed, and dyeing and finishing were performed in accordance with Example 2, except that an untwisted twisted union yarn obtained by Z twisting at 580 twists/m of a 20-count cotton single yarn was used for a pile yarn as comparison with Example 2. The finished towel cloth had a thickness of 3.24 mm, a basis weight of 408 $g/m^2$, and a degree of bulkiness of 7.94 $cm^3/g$.

C. Evaluation results of Example 2 and Comparative Example 3

In Example 2, the degree of bulkiness was 9.71 $cm^3/g$, which was a 22% increase based on that of Comparative Example 3, and the towel cloth exhibited a bulky, and very soft and puffy texture. Further, fluff dropping was less caused. For the water absorption rate, one drop of water was added from a height of 10 cm in a simple manner with a ready dropping pipet, and the water absorption rate thereof was measured. As a result, it was confirmed that water was absorbed in one second or less, and the water absorbency was also excellent. Thus, Example 2 was a dark blue towel cloth excellent in functionalities of texture, fluff dropping, and water absorbency. On the other hand, Comparative Example 3 was a conventional towel cloth having a lower bulkiness compared to Example 2, and inferior in all of the puffy texture, fluff dropping, and the water absorbency (water absorption rate; two seconds).

Example 3

A. Yarn Twisting Processing

One roving equivalent to a cotton with a count of 22 and one 110-dtex, 48-filament polyester multifilament filament fiber fully oriented yarn were placed on the left and right sides as pile yarns. These were combined to two, and were primarily twisted at 1050 times per meter in the Z direction (left twist), thereby forming a twisted union yarn of a 16.6-count single yarn (1050 twists/m, Z twist). Subsequently, continuously, the primarily twisted single yarn was finally twisted at 580 twists/m in S twist (right twist) in the opposite direction to that of the single yarn by the belt made of rubber of Example 1, and was untwisted (untwisting rate: 55%). This resulted in a twisted union finished yarn of a 16.6-count single yarn Z twisted at 470 twists/m, untwisted (1050 twists/m Z to 580 twists/m S untwisting to 470/m Z).

B. Processing of Woven Fabric

Then, using the untwisted twisted union finished yarn of the 16.6-count single yarn for the pile yarns on the front and the rear of the woven fabric, using a 16-count single yarn of a ring spun yarn of cotton for the warp ground yarn, and a 20-count single yarn of a ring spun yarn of cotton for the weft ground yarn, weaving was performed into a towel cloth with a vertical density of 60 yarns/inch and a horizontal density of 42 yarns/inch, with mixing ratios of the pile yarn; 70% cotton and 30% polyester, and with mixing ratios of the whole towel cloth; 79% cotton and 21% polyester. The woven grey fabric was subjected to desizing scouring, and bleaching processing, and was dyed on the polyester side with a gray disperse dye at 130° C. for 40 minutes, and then, was dyed on the cotton side with a black reactive dye at 80° C. for 40 minutes, and set and finished. The finished towel cloth had a thickness of 4.44 mm, a basis weight of 396 g/m$^2$, and a degree of bulkiness of 11.21 cm$^3$/g.

Comparative Example 4

Weaving was performed, and dyeing and finishing were performed in accordance with Example 3, except that the untwisted twisted union yarn by Z twist at 1050 twists/m was used for a pile yarn as comparison with Example 3. The finished towel cloth had a thickness of 3.64 mm, a basis weight of 417 g/m$^2$, and a degree of bulkiness of 8.73 cm$^3$/g.

C. Evaluation results of Example 3 and Comparative Example 4

In Example 3, the degree of bulkiness was 11.21 cm$^3$/g, which was a 28% increase of based on that of Comparative Example 4, and the towel cloth exhibited a bulky, and elastic and puffy texture. Further, fluff dropping was less caused. With the same simple water absorption rate evaluation as that of Example 2, the result was one second or less, indicating that the towel cloth had a good water absorbency, and had an excellent functionality. Further, Example 3 was the towel cloth which was dried quickly upon washing, underwent less washing shrinkage, and was excellent in dimensional stability, was dyed in chambray with gray and black in a shaded manner, and rich in color design property. On the other hand, Comparative Example 4 was the towel cloth inferior in all of the characteristics of the bulkiness, the puffy texture, fluff dropping, and the water absorbency (water absorption rate; three seconds) to Example 3.

What is claimed is:

1. A towel cloth comprising a ground weave including a warp ground yarn and a weft ground yarn crossing each other therein, and a pile yarn locked to the ground weave, wherein at least one of the warp ground yarn, the weft ground yarn, and the pile yarn is formed of a twisted union finished yarn, and the twisted union finished yarn including a twisted union yarn-including two or more rovings twisted in a primary twisting direction as a single yarn, one of the rovings having an even twist, and at least another of the rovings partially having a twist with irregular strand length and twisting angle, the twisted union yarn undergoing fiber opening and being puffy.

2. The towel cloth according to claim 1, wherein the twisted union yarn includes a large number of strong tangling parts at the irregular twist sites, and the twisted union finished yarn has fine fluffs appearing from the strong tangling parts at a surface of the twisted union finished yarn.

3. The towel cloth according to claim 1, wherein the twisted union finished yarn is configured by being untwisted in the opposite direction within the range of 5 to 80% based on the number of primary twists.

4. The towel cloth according to claim 1, wherein the twisted union finished yarn comprises a cotton and a synthetic fiber with mixing ratios of 40 wt % or more of the cotton and less than 60 wt % of the synthetic fiber.

5. The towel cloth according to claim 1, wherein a yarn count of the twisted union finished yarn is 5 to 300.

6. The towel cloth according to claim 1, wherein a basis weight of the towel cloth is 80 to 1000 g/m$^2$.

7. A method for manufacturing a towel cloth comprising a ground weave including a warp ground yarn and a weft ground yarn crossing each other therein, and a pile yarn locked to the ground weave, at least one of the warp ground yarn, the weft ground yarn, and the pile yarn being formed of a twisted union finished yarn, wherein the twisted union finished yarn is manufactured by the steps of:

paralleling two or more rovings in the same direction, and primarily twisting the rovings as a single yarn, thereby forming a twisted union yarn; and finally twisting the twisted union yarn in the opposite direction to a primary twisting direction for untwisting, and forming a twisted union finished yarn, wherein one of the rovings is formed with an even twist, and at least another of the rovings partially formed with a twist with irregular strand length and twisting angle, and wherein the twisted union yarn undergoing fiber opening and being puffy.

8. The method for manufacturing a towel cloth according to claim 7, wherein the step of forming the twisted union finished yarn includes scratching the twisted union yarn simultaneously with untwisting of the twisted union yarn.

9. The method for manufacturing a towel cloth according to claim 7, wherein the step of forming the twisted union finished yarn includes untwisting the twisted union yarn at a revolution speed within the range of 5 to 80% of the revolution speed of primary twisting.

* * * * *